United States Patent [19]

Takahira

[11] Patent Number: 4,828,001

[45] Date of Patent: May 9, 1989

[54] STEEL CORD FOR REINFORCING AN AUTOMOBILE TIRE

[75] Inventor: Koji Takahira, Nara, Japan

[73] Assignee: Toyo Tire & Rubber Co., Ltd., Osaka, Japan

[21] Appl. No.: 892,850

[22] Filed: Aug. 4, 1986

[30] Foreign Application Priority Data

Aug. 6, 1985 [JP] Japan ..... 60-172909

[51] Int. Cl.[4] ..... D02G 3/48

[52] U.S. Cl. ..... 152/451; 57/902

[58] Field of Search ..... 152/451, 527, 556, 548; 57/206, 215, 219, 902, 212, 237

[56] References Cited

U.S. PATENT DOCUMENTS 2,491,293 12/1949 Zerr ..... 57/215 X
3,922,841 12/1975 Katsumata et al. ..... 57/215
4,268,573 5/1981 Baillievier ..... 152/451 X
4,333,306 6/1982 Yamashita et al. ..... 57/902 X
4,399,853 8/1983 Morimoto et al. ..... 57/902 X
4,506,500 3/1985 Miyauchi et al. ..... 57/219 X
4,628,683 12/1986 Bourgois et al. ..... 152/556 X
4,644,989 2/1987 Charvet et al. ..... 152/451

FOREIGN PATENT DOCUMENTS 51-92329 8/1976 Japan .

*Primary Examiner*—Michael W. Ball
*Assistant Examiner*—Ramon R. Hoch
*Attorney, Agent, or Firm*—Finnegan, Henderson, Farabow, Garrett, & Dunner

[57] ABSTRACT

A steel cord comprises at least nine filaments which are twisted in substantially the same direction with substantially the same pitch. A coil formed by each filament has a diameter which is variable along the cord central line. Most of the filaments are interwined with one another without forming layers.

5 Claims, 1 Drawing Sheet

STEEL CORD FOR REINFORCING AN AUTOMOBILE TIRE

BACKGROUND OF THE INVENTION

This invention relates to a steel cord for reinforcing an automobile tire, a method of manufacturing the steel cord, and an automobile tire reinforced with the steel cord.

A bundle twisted steel cord is well-known as one example of the steel cord which is used to reinforce an automobile tire. A conventional method of manufacturing a steel cord with a brancher type wire twisting machine (cf. Japanese Patent Application (OPI) No. 92329/1976 (the term "OPI" as used herein means an "unexamined published application") will be described with reference to FIG. 1. Filaments passing through several guide holes in an end plate 1 are drawn together by a collector 2 and temporarily twisted by a first twisting roller 3. The filaments thus treated are then supplied to a guide 4 and a guide roller 6 at the end of a flyer 5, and then to a guide roller 6 at the end of another flyer 5 and a guide 4. That is, as the two flyers 5 rotate, the filaments are twisted between the guides 4 and 4, and are temporarily twisted by a second twisting roller 7 again. The filaments thus treated, namely, a steel cord A, is wound on a winding reel 8. The end plate 1, as shown in FIG. 4 has a central guide hole 1*a* and a number of peripheral guide holes 1*b*. A core strand formed by twisting three filaments is inserted into the central guide hole 1*a*. Side strands, namely, filaments are inserted into the peripheral guide holes 1*b*. Accordingly, the resultant steel cord, as shown in FIG. 5, comprises: the core strand Aa made up of three filaments (black circles); and several side strands (white circles) Ab twisted around the core strand Aa. That is, in the conventional bundle twisted steel filament, a number of filaments form at least two layers, and have the same twisting direction and the same twisting pitch, and the diameters of the coils formed by the filaments are constant respectively. Accordingly, the filaments forming the central layer at a point of the steel cord form the central layer at any other points of the steel cord, and similarly the filaments forming the intermediate layer at a point of the steel cord form the intermediate layer at any other points of the steel cord.

As is apparent from the above description, in the conventional bundle twisted steel cord, the filaments are arranged in such a manner that filaments forming a layer are never shifted to form other layers. Therefore, the filaments forming the intermediate layer and the central layer are liable to come off. During running of the automobile, the filaments of the layers other than the outermost layer of this conventional bundle twisted steel cord may come off inside the tire, thus causing the blowout of the tire or the leakage of air from the tire. Furthermore, sometimes the filaments come off outside the tire, as a result of which water goes into the tire, thus corroding the steel cord.

SUMMARY OF THE INVENTION

Provided according to a first aspect of this invention is a steel cord which comprises at least nine filaments which are twisted in the same direction with substantially the same twisting pitch in such a manner that in the coil formed, each filament is arranged at a variable distance from the central axis of the cord at different positions along the length of the cord, and most of the filaments are intertwined with one another without forming layers.

Provided according to a second aspect of the invention is a method of manufacturing a steel cord in which filaments forming the steel cord are divided into groups each having at least two filaments, and the groups of filaments are supplied to a wire twisting machine through at least three guides.

Provided according to a third aspect of the invention is to provide an automobile tire reinforced with the steel cord provided according to the first aspect of the invention.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention relates to a steel cord comprising at least nine filaments formed in groups of at least two filaments, said filaments being twisted together at substantially the same twisting pitch and in substantially the same twisting direction, each filament forming a series of coils along the length of the cord, said coils exhibiting a variable diameter along the length of the cord wherein each said filament is intertwined with other filaments in its group and with filaments in other groups to prevent the formation of layers of filaments along the length of the steel cord.

The accompanying drawings, which are incorporated in and constitute a part of this specification, illustrate one embodiment of the invention and, together with the description, serve to explain the principles of the invention.

DETAILED DESCRIPTION OF THE INVENTION

Reference will now be made in detail to the present preferred embodiment of the invention, an example of which is illustrated in the accompanying drawings. Wherever possible, the same reference numbers will be used throughout the drawings to refer to the same or like parts.

The diameter of filaments forming a steel cord is preferably 0.10 to 0.40 mm. The total number of filaments is at least nine, preferably twelve to twenty-eight. The filaments are divided into groups each comprising at least two filaments, preferably three to four filaments, and supplied through at least three guides to a wire twisting machine. The number of guides should be increased according to the number of filaments, preferably four to nine guides. It is preferable that the numbers of the filaments passing through the guides are equal to each other; however, it is not always necessary.

Figure 1:
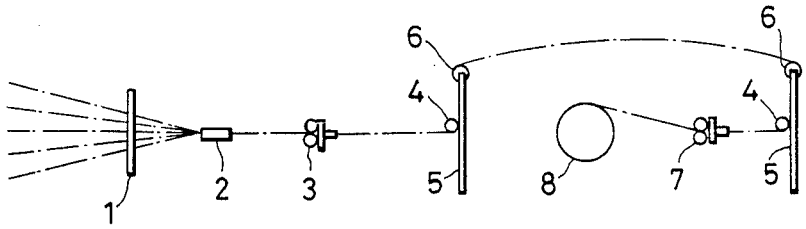
FIG. 1 is a side view outlining the arrangement of the buncher type wire twisting machine which is employed in this invention by way of example.
Figure 2:
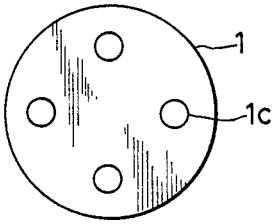
FIG. 2 is a side view showing an end plate which is employed in the embodiment of the invention; The parts (a) through (e) of FIG. 3 are sectional views of a steel cord, a preferred embodiment of the invention, taken every 0.5 m, showing the arrangement of filaments.
Figure 3A:
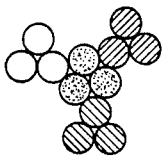
Figure 3B:
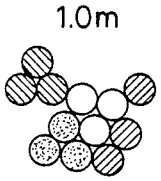
Figure 3C:
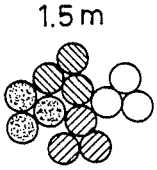

In the case where a steel cord having twelve filaments is manufactured with a typical buncher type wire twisting machine, an end plate 1, as shown in FIG. 2, has four guide holes 1*c* arranged in the peripheral portion at equal angular intervals. Three filaments are inserted into each of the guide holes 1*c*. In the manufactured steel cord, the twisting pitch is the same; however, the diameter of the coil formed by each filament is variable along the cord central line, and most of the filaments intertwine at random without forming layers. The sections of the steel cord taken every 0.5 m are as shown in the parts (a) through (e) of FIG. 3.

In FIG. 3, the filaments indicated by white, left oblique line and right oblique line circles pass through the predetermined guide lines, respectively. For instance, in the case of three white filaments, in FIG. 3(*a*), the three white filaments are located at the upper left part of the cord and one of them is in contact with the black filaments. In FIG. 3(*b*), the three white filaments are located substantially at the center of the cord and are in contact with the black filament and the left-oblique line filaments. In FIG. 3(*c*), the three white filaments are located at the right middle part of the cord and one of them is in contact with the right-oblique line filament and the left-oblique line filament. In FIG. 3(*d*), the three white filaments are in contact with the right-oblique line filaments and the black filament. In FIG. 3(*e*), one of the three white filaments is in contact with the black filament and the left-oblique line filament, and the remaining two white filaments are in contact with three right-oblique line filaments. As is apparent from the above description, the intertwining of the filaments and the sectional configuration of the steel cord are variable and completely at random in the longitudinal direction. Additionally, the peripheral length of the section of the steel cord that is, the distance around the steel cord at a given section, is larger than that of the section of the steel cord shown in FIG. 5.

The guides through which the filaments pass are not limited to the guide holes formed in the peripheral portion of the end plate; that is, they may be grooved-rollers or snail wires. In the above-described embodiment, these guides are arranged in a plane perpendicular to the collector; however, they may be arranged in a front-to-rear direction of the collector. Furthermore, while the invention has been described with reference to the buncher type wire twisting machine, the latter may also be replaced by the Chebler type wire twisting machine.

The above-described steel cord can be used to reinforce the carcass, the belt and the chafer of an automobile tire, and the remaining part can be reinforced with the conventional steel cord or organic fiber cord.

The filaments, after being divided with at least three guides, are supplied to the wire twisting machine. Therefore, in the manufactured steel cord, most of the filaments are intertwined with one another without forming layers. Therefore, the filament drawing resistance is increased, and the peripheral length of the section of the steel cord is increased, with the result that the force of adhesion to rubber is increased. Furthermore, rubber can readily go into the inside of the cord, with the result that the rubber scarcely peels off the steel cord.

EXAMPLE

Figure 4:
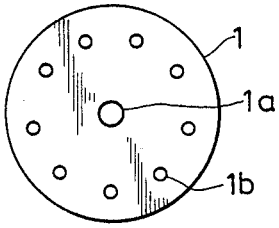
FIG. 4 PRIOR ART
FIG. 4 is a front view of a conventional end plate.
Figure 3D:
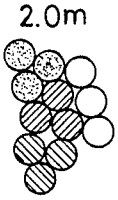
Figure 3E:
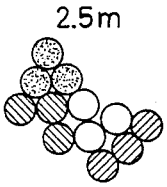
Figure 5:
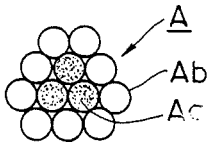
FIG. 5 PRIOR ART
FIG. 5 is a sectional view showing the arrangement of a conventional steel cord.

A steel cord in which the filaments are arranged at random and intertwined with one another as shown in FIG. 3 was manufactured. That is, twelve (12) steel filaments 0.22 mm in diameter were divided into four groups each comprising three steel filaments. The four groups of steel wires were supplied through four guide holes of the end plate shown in FIG. 2 to the buncher type wire twisting machine, so that the filaments were twisted with a twisting pitch of 12.5 mm, to form the steel cord. As for a comparison example, a steel cord whose section was as shown in FIG. 5 was manufactured by using the end plate illustrated in FIG. 4. Thereafter, 10.00R20-14PR radial tires were manufactured by using the above-described steel cords. The above-described steel cords were arranged in the first belt layer (the outermost layer) with an end number of 14 pieces/2.54 cm, the conventional steel cords of $3\times0.20$ mm$+6\times0.38$ mm were arranged in the second, third and fourth belt layers with an end number of 13 pieces/2.54 cm (the angle being 20 degrees for each layer), and the steel cords were arranged in the carcass with an end number of 14 pieces/2.54 cm.

The performances of the steel cords, and the tire running performances are as indicated in the following Table:

TABLE

| | Concrete example | Comparison example |
|---|---|---|
| Cord | | |
| Strength(kg) | 120 | 118 |
| Break elongation(%) | 2.83 | 2.76 |
| Cord weight (g/m) | 4.00 | 4.03 |
| Fatigue resistance (cycle) | $2.6\times10^7$ | $1.7\times10^7$ |
| Drawing resistance(kg) | 29(Break) | 38 |
| Rubber drawing resistance (kg) | 30(Break) | 36 |
| Tire running distance (km) | 101,800 | 73,800 |

As is apparent from the Table, the concrete example is substantially equal in strength, elongation and weight to the comparison example; however, the cord fatigue resistance of the concrete example is 1.5 times that of the comparison example. The drawing resistance, and the rubber drawing resistance of the concrete example are much larger than those of the comparison example. The tire running distance of the concrete example is sufficiently long, because the tire of the concrete example was not broken although it was run 100,000 km. On the other hand, in the case of the tire of the comparison example, the filaments of the first belt layer came off to stick into the rubber tube, thus causing the puncture.

In the above Table, the fatigue resistance is determined as follows: A steel cord is buried in a rubber material 2 mm in diameter and vulcanized to form a specimen, and the number of cycles is measured until the specimen, vibrated by Hunter fatigue tester under a stress of 70 kg/mm$^2$, is broken. The number of cycles thus measured is used to indicate the fatigue resistance. The larger the number of cycles, the higher the fatigue resistance. The drawing resistance is determined as follows: At 50 mm from one end of a steel cord 200 mm in length, the filaments except for three central core filaments are removed, while at 50 mm from the other end only the three core filaments are cut away and the remaining peripheral filaments are twisted to form a specimen. The specimen is pulled at a rate of 5 cm/min with its two ends held by the chucks of a tension tester, and its tensile strength is measured until the core filaments are drawn out. The rubber drawing resistance is determined as follows: Similarly as in the specimen for the above-described fatigue resistance, a steel cord is buried in the vulcanized rubber, to form a specimen. The specimen is treated similarly as in the case of the specimen for the above-described drawing resistance, and its tensile strength is measured in the same manner as the tensile strength of the specimen for the drawing resistance described above.

The tire running performances were determined as follows: The tires were placed on a 11-ton truck. The internal pressure of the tires was set to 7.25 kg/cm$^2$. The truck, loaded with 33 tons of concrete blocks, was run on the asphalted road of the tire testing field, and the truck running distance was measured until it became impossible to run the truck. The truck running distance represents the tire running performance in the Table. The tire running distance of the concrete example was measured until it became impossible for the truck to run because of the wear of the tires.

Employment of the steel cord according to the invention can improve the drawing resistance and the rubber drawing resistance. The steel cord of the invention can be manufactured with the conventional wire twisting machine if the guide components are replaced. Furthermore, an automobile tire reinforced with the steel cord according to the invention is remarkably improved in running performance.

Other embodiments of the invention will be apparent to the person skilled in the art from consideration of the specification and practice of the invention disclosed herein. It is intended that the specification and examples be considered as exemplary only, with a true scope and spirit of the invention being indicated by the following claims.

I claim:

1. A steel cord comprising at least nine filaments in strands formed of groups of at least two filaments each, said filaments being twisted together at substantially the same twisting pitch and in substantially the same twisting direction to intertwine each filament with other filaments in the same group and to intertwine each filament group with other filament groups to achieve variable and asymmetric cord cross-sections along the length of the cord for preventing the formation of layers of filaments, wherein each filament forms a series of coils along the length of the cord, said filament coils exhibiting a variable diameter along the length of the cord.

2. The steel cord of claim 1, wherein four groups are provided and wherein each group includes three filaments.

3. The steel cord of claim 1, wherein seven groups are provided and wherein each group includes three filaments.

4. The steel cord of claim 1, wherein nine groups are provided and wherein each group includes three filaments.

5. The steel cord of claim 1, said steel cord having a variable peripheral length for a given section along the length of the steel cord.

* * * * *